United States Patent [19]
Sindelar
[11] 4,318,295
[45] Mar. 9, 1982

[54] DRIVING ASSEMBLY FOR POWER PRESS PRODUCING SLOW-DOWN ON CLOSURE OF DIES

[75] Inventor: William E. Sindelar, Darien, Ill.

[73] Assignee: Danly Machine Corporation, Chicago, Ill.

[21] Appl. No.: 153,718

[22] Filed: May 27, 1980

[51] Int. Cl.[3] ..... B21J 9/18
[52] U.S. Cl. ..... 72/450; 100/282; 100/283
[58] Field of Search ..... 72/450, 452; 100/283, 100/282, 292; 74/570, 116, 835

[56] References Cited

U.S. PATENT DOCUMENTS

| | | | |
|---|---|---|---|
| 2,085,799 | 7/1937 | Glasner | 72/450 |
| 2,550,064 | 4/1951 | Ward | 72/450 |
| 2,781,015 | 2/1957 | Dehn | 72/452 |
| 3,052,200 | 9/1962 | Dehn | 100/282 |
| 3,695,090 | 10/1972 | Kita | 72/450 |
| 4,107,973 | 8/1978 | Smejkal | 72/450 |
| 4,138,904 | 2/1979 | Otsuka | 74/116 |
| 4,238,950 | 12/1980 | Carrieri | 72/450 |

FOREIGN PATENT DOCUMENTS

| | | | |
|---|---|---|---|
| 715351 | 2/1980 | U.S.S.R. | 72/450 |

*Primary Examiner*—Gene P. Crosby
*Attorney, Agent, or Firm*—Leydig, Voit, Osann, Mayer & Holt, Ltd.

[57] ABSTRACT

A power metal-forming press of the underdrive type having a pair of laterally spaced rocker shafts journaled in the base. A set of vertical pull rods are connected to arms at the ends of the shafts for reciprocating the press slide. Driving subassemblies are provided at the near side and far side of the press each including a main drive gear carrying an eccentric. A pitman pivotally engaging the eccentric has a short arm which is coupled via a connecting link to a rocker arm on one of the shafts. The pitman also has a long arm extending generally in the opposite direction, the end of the long arm being guided with respect to the frame along a generally longitudinal path. The long arm is so angled with respect to the connecting link under conditions of bottoming of the slide that upon rotation of the main drive gear the short arm traces a generally elliptical path having a major axis which bears an acute angle to the bottoming orientation of the connecting link. As a result the slide moves relatively slower as it approaches its bottoming position and relatively faster as it leaves its bottoming position.

4 Claims, 7 Drawing Figures

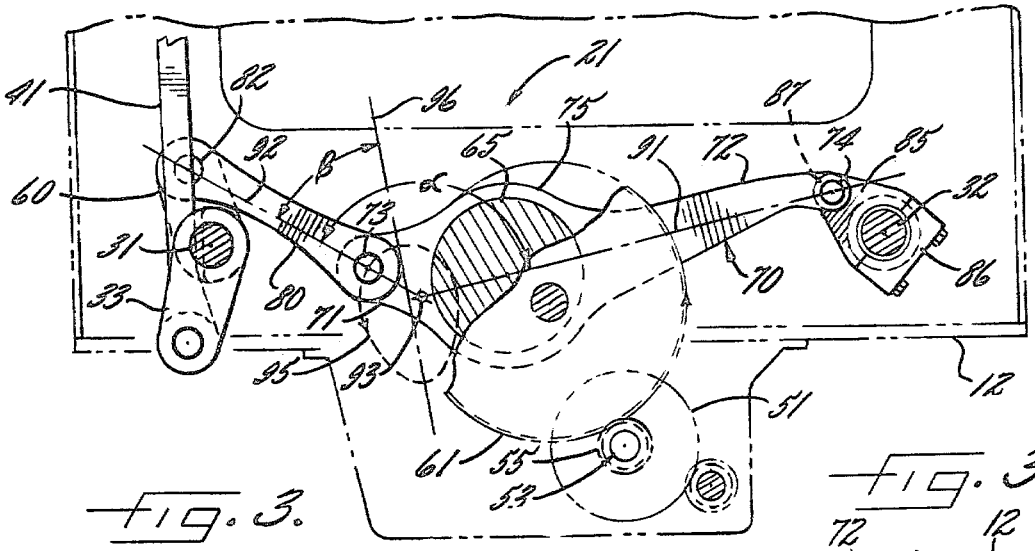
FIG. 3.
FIG. 3a.
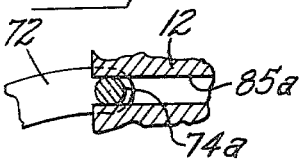
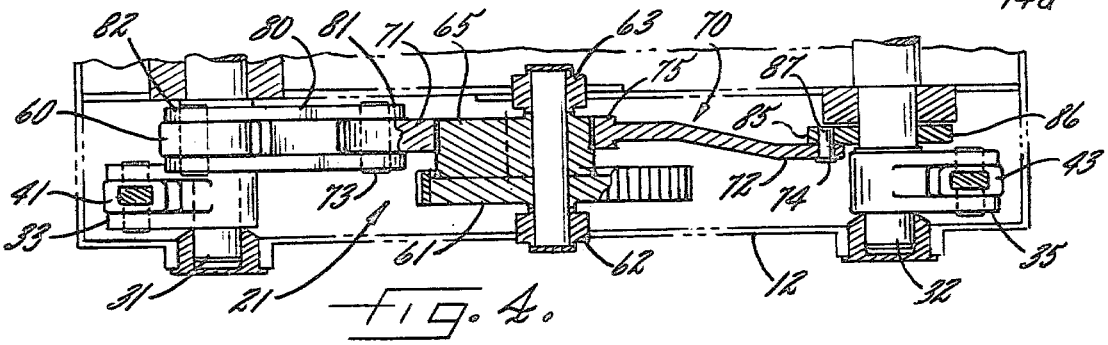
FIG. 4.
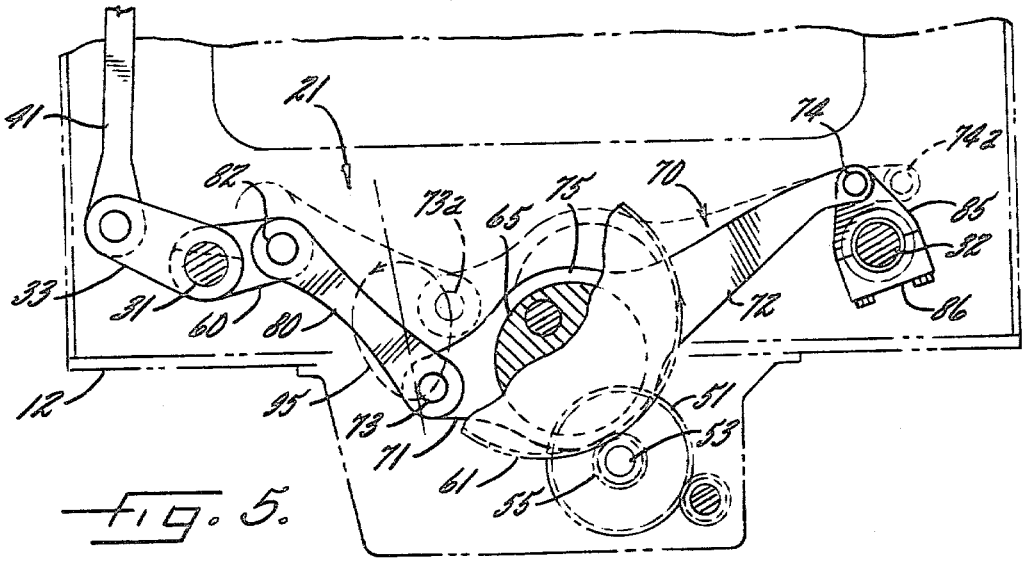
FIG. 5.

DRIVING ASSEMBLY FOR POWER PRESS PRODUCING SLOW-DOWN ON CLOSURE OF DIES

In a power press having conventional driving means the closing speed of the press slide is a mirror image of the opening speed. It has long been recognized that it would be desirable to reduce the closing speed and to increase the opening speed. The result of this action, on closure, in addition to reducing the draw speed, is to reduce the amount of wear on the bed cushions for a given press rate or, alternatively, to enable an increased rate of production, and to reduce noise level. A reduced speed of approach at bottoming also translates into an increase in the tonnage capacity of the press. Increased speed of opening is of advantage since it provides quicker access to the die for unloading and reloading purposes.

Two types of modified drives have been utilized to achieve this effect, commonly referred to as "slow-down", namely the so-called "dynamatic" drive and use of a twospeed clutch to bring about a cyclical change in drive ratio. Both of the latter systems are relatively expensive and require periodic maintenance. It has been proposed, in addition, to accomplish "slow-down" by use of a special linkage as disclosed in the following patents: U.S. Pat. No. 4,107,973—Smejkal et al., U.S. Pat. No. 4,138,904—Otsuka et al., U.S. Pat. No. 2,781,015—Dehn et al., and British Pat. Nos. 1,356,595 and 1,435,390. However, such constructions have not been well suited for use in presses of the underdrive type.

It is, accordingly, an object of the present invention to provide a drive assembly for an underdrive press which is simple, effective, and highly economical. It is a related object to provide a drive system for an underdrive press which achieves slow-down through a simple modification of a conventional pitman arrangement, which modification can be effected at a cost which is extremely low compared to the cost of the press. In this connection it is an object to provide a drive system for an underdrive press which may be added as a minor modification to existing designs.

It is a further object to provide a "slow-down" drive system for an underdrive press which is not only economical in original cost but which is highly reliable and capable of operating for long periods of time without care or maintenance.

Other objects and advantages of the invention will become clear upon reading the attached detailed description and upon reference to the drawings in which:

FIG. 3 is an elevational view of the drive system at the "near" side of the press with the parts shown in reference position corresponding to the bottom position of the press slide.

FIG. 3*a* is a fragmentary elevational view of an alternative arrangement of the guiding means shown in FIG. 3.

FIG. 4 is a top view of the mechanism shown in FIG. 3.

FIG. 5 is a stop motion view, similar to FIG. 3, but showing the position of the parts with the slide fully open.

Figure 6:
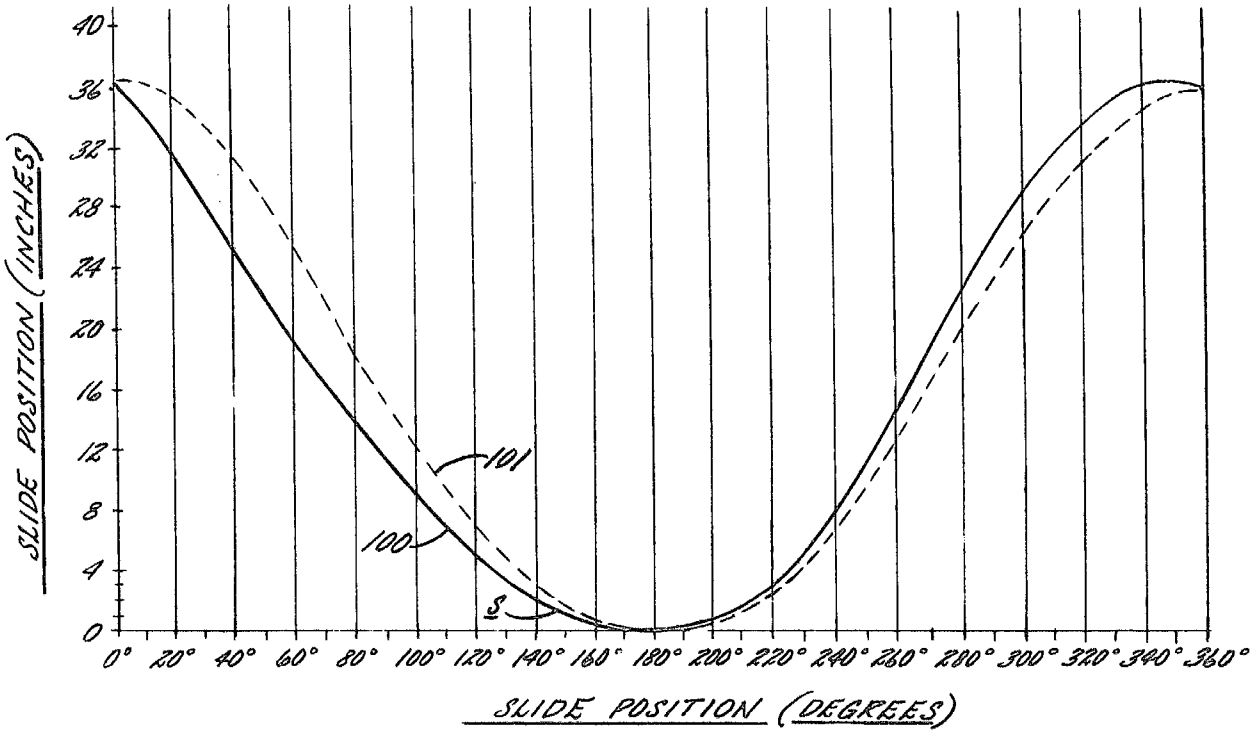

FIG. 6 is a motion diagram showing slide position as a function of the angular position of the main drive gear and showing the reduction in closing speed and increase in opening speed in a typical press cycle.

While the invention has been described in connection with a preferred embodiment, it will be understood that I do not consider the invention to be limited to the particular embodiment which has been shown but I intend, on the contrary, to cover the various alternative and equivalent constructions included within the spirit and scope of the appended claims.

Figure 1:
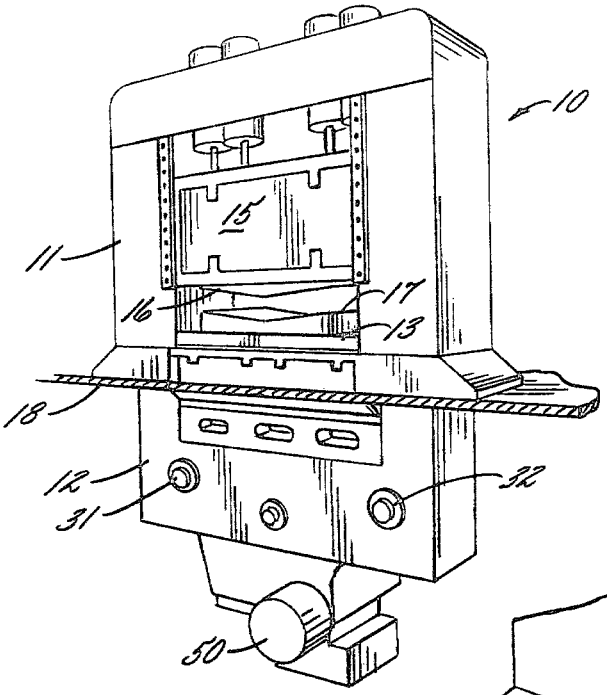
FIG. 1 is a perspective view of a simple form of underdrive press embodying the present invention.

Turning to the drawings there is shown in FIG. 1 a typical underdrive press 10 having an upright frame 11 and base 12 providing a bed 13. A slide 15 is vertically reciprocable in the frame between the illustrated upraised position and a bottom position. The slide and bed have provision for mounting of upper and lower cooperating dies 16, 17. A press of this type is normally mounted so that it extends substantially below floor level indicated at 18.

Figure 2:
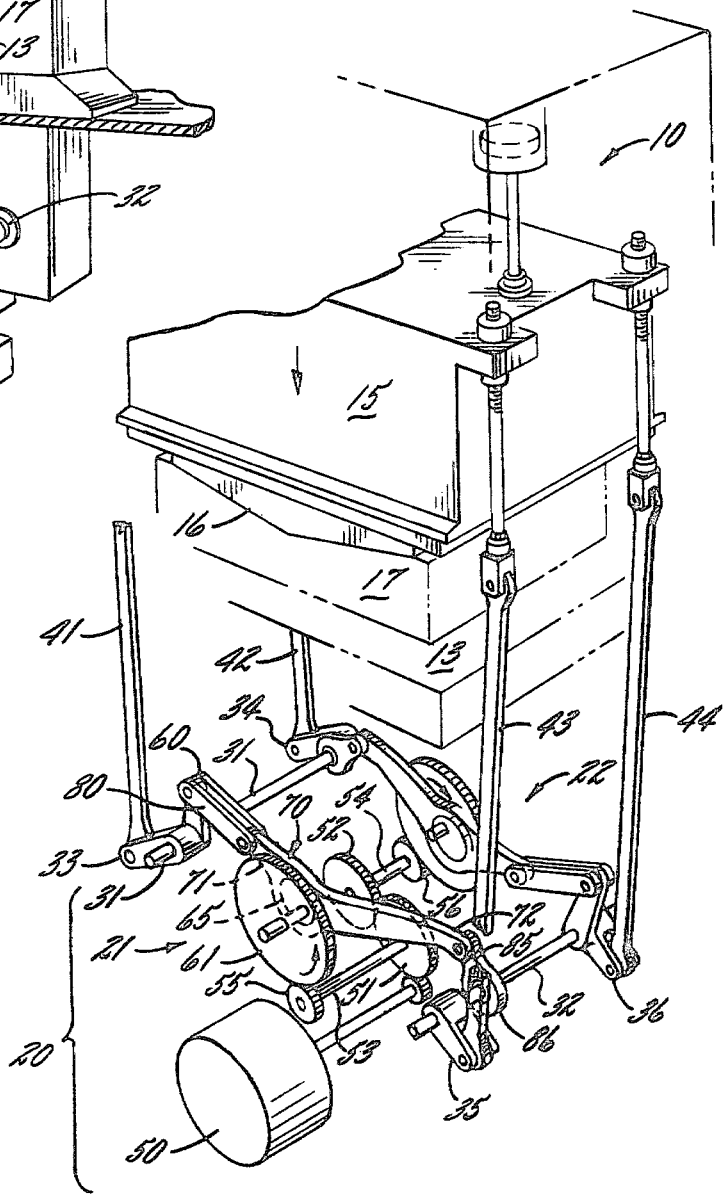
FIG. 2 is a perspective view of the drive system with the press slide being indicated diagrammatically.

Turning to FIG. 2 there is shown a drive system 20 which distinguishes the present construction including a "near side" subassembly 21 and a "far side" subassembly 22.

As is conventional in presses of the underdrive type, the press employs a pair of laterally spaced rocker shafts 31, 32 which are journaled in the base 12 of the press and which extend horizontally from the near side of the far side. The rocker shaft 31 has pull rod arms 33, 34 at its ends while the shaft 32 is similarly equipped with arms 35, 36. The pull rod arms engage vertically extending pull rods 41, 42 and 43, 44 which are connected at their upper ends to the slide 15 for reciprocating the slide between its upraised and bottoming positions.

For the purpose of rocking the rocker shafts 31, 32, a drive motor 50 is provided having a pinion which drives a pair of intermediate gears 51, 52 in opposite directions. The intermediate gears have respective shafts 53, 54 with pinions 55, 56 for driving the near side and far side subassemblies 21, 22.

Because of the substantial identity of the subassemblies, attention may be focused upon the subassembly 21 at the near side as set forth in FIGS. 3 and 4. Here it will be noted that the subassembly 21 terminates in a rocker arm 60 which is integral with the rocker shaft 31 and which serves to oscillate it back and forth. Radially spaced from the rocker arm at the center of the press is a main drive gear 61, supported in bearings 62, 63 (see FIG. 4). On the rear side of the main drive gear 61 is an eccentric 65 which pivotally engages a pitman 70.

In accordance with the invention the pitman has a short arm extending generally in the direction of the rocker arm and a long arm extending in a direction generally opposite thereto, the short arm being coupled to the rocker arm by a connecting link, while the end of the long arm is guided along a generally longitudinal path with respect to the press frame. The connecting link has a reference orientation, illustrated in FIG. 3, when the slide is in its bottom position. The angle of the long arm with respect to the orientation of the connecting link when the linkage is in the bottoming or "reference" state, and the orientation of the guiding means, is such that upon rotation of the main drive gear the pivot on the short arm of the pitman traces a generally elliptical path having a major axis which bears an acute angle to the reference orientation of the connecting link, with the result that the slide moves relatively slower as it approaches its bottom position and relatively faster as it leaves its bottom position.

Thus the pitman 70 has a short arm 71 and a long arm 72 extending in generally opposite directions. The arms have pivot connections 73, 74 at their respective outer ends. The central portion 75 of the pitman is enlarged to encircle the eccentric 65 for rocking movement in a plane parallel to the plane of the drive gear.

Interposed between the short arm 71 of the pitman and the rocker arm 60 is a connecting link 80 having a first pivot connection 81 and a second pivot connection 82 for respective pivoting to the pitman and rocker arm.

Turning to the long arm 72 of the pitman, the end 74 thereof is guided for generally longitudinal movement by pivoting to a short auxiliary link 85 having a body portion 86 which encircles the rocker shaft 32 for free swinging movement and a projecting portion which provides a pivot 87 which engages the pitman arm. So that the end of the long arm is guided for longitudinal movement, the long arm has a length such that the average orientation of the auxiliary link is generally at right angles to the average orientation of the arm.

The use of the auxiliary link 85 freely swingable about the companion rocker shaft 32 has the advantage of economy since the rocker shaft is already in place and since the cost of a simple link for making connection to it is quite negligible. It will be understood, however, that the invention is not limited to guidance of the end of the long arm of the pitman by a link and, if desired, the end of the arm may be guided for generally longitudinal movement by suitable way surfaces supported on the press frame, a matter well within the skill of the art. FIG. 3*a* shows such an alternative guiding means in which the end 74*a* of the long arm 72 of the pitman is guided for longitudinal movement by a projection on the end 74*a* which fits into a guiding slot 85*a* on the press frame 12.

In accordance with one of the important aspects of the present invention, the axis of the long arm of the pitman, indicated at 91, is rather sharply angled with respect to the axis of the link 80, under reference conditions, the link axis being indicated at 92. These axes intersect at point 93, where the angle between them, in the reference condition illustrated in FIG. 3, is $\alpha$. Such angle, in the illustrated geometry which represents the preferred embodiment of the invention, is 142 degrees. This angle should preferably not exceed 150 degrees and may be as low as 140 degrees without substantial sacrifice in the benefits of the invention.

In operation it is found, using the above geometry, that the pivot of the short arm 71, and which is connected to the driving end 81 of the connecting link, traces a generally elliptical path 95 having a major axis 96 which bears a sharply acute angle indicated at $\beta$ with respect to the link axis 92, the angle in the present instance being on the order of 50 degrees but which may vary, without substantial sacrifice in result, from, say 45 degrees to 55 degrees.

By driving the link which actuates the rocker arm so that it moves about an elliptical rather than a circular locus and by orienting the link (when in its reference slide-at-bottom position) so that the link axis makes a sharply acute angle with the major axis of the ellipse, a condition is established in which the link moves into its bottomed condition, illustrated in FIG. 3, at a relatively slower rate than it is retracted. Since the link is positively coupled to the press slide, the slide also moves more slowly as it approaches is bottom state and more rapidly as it is retracted, thereby giving rise to the advantages set forth above. In short, the generation of a generally elliptical locus to drive a link which is cocked at an angle to the major axis of such locus produces a non-symmetrical driving state. Thus bottoming may be caused to occur at a desired point in the driving cycle but the velocities going into and coming out of the bottoming condition are, in accordance with the present invention, non-symmetrical.

While from the standpoint of pure geometry the path indicated at 95 may not be a true ellipse, it sufficiently resembles an ellipse to warrant being labeled as such.

The effect of the invention in terms of slide velocity may be further understood by a consideration of FIG. 6 which is a motion diagram in which the slide position, from open to bottom, has been plotted as a function of the angular position of the main drive gear. The curve applicable to the present invention, and indicated at 100, it will be noted, has a lower slope, s, than the conventional velocity curve 101. This means that the velocity of the slide, which is proportional to the slope, as it approaches the bottom position, is substantially reduced. Conversely it is noted that the velocity of the slide in the opening or retract direction is greater than that which would occur using a conventional pitman and in the absence of the invention. In short, while the conventional curve displays symmetry about the point of bottoming, the curve 100, representative of the invention, is unsymmetrical. The degree of dissymmetry may be increased, if desired, by slightly adjusting the pitman geometry to bring about a "flatter" ellipse in which the length of the major axis exceeds that of the minor axis by an even greater degree. This may be accomplished, for example, by adjustment in the length ratio of the short and long arms 71, 72 in a direction to reduce the disparity between them. A complete cycle of operation can be understood from FIGS. 3 and 5. FIG. 3 shows the lower dead center, or bottoming, condition and the main gear 61 will be understood to be rotating counterclockwise causing movement of the inner end of the link 80 about the elliptical locus in the direction of the arrow. The slide continues to rise until the upper deadcenter condition is reached as illustrated in FIG. 5. Note, however, that this may not correspond to the condition of maximum extension of the long arm 72 which continues to move outwardly until the pivots of the short and long arms of the pitman occupy positions 73*a*, 74*a* shown dot-dash in FIG. 5.

It will be noted that the distance, on the elliptical locus, between lower deadcenter and upper deadcenter is relatively short, occupying less than one-half of the length of the ellipse, while the length of the elliptical path between the upper deadcenter position and return to lower deadcenter position is substantially longer. This means that the geometry producing the ellipse has utility not only because of the effect upon the slope (FIG. 6) in the region of bottoming but because the total rise time of the slide is shortened while the total time for descent is relatively lengthened, contributing to the advantages mentioned above.

It will be apparent that the objects of the invention have been amply satisfied. Slow-down on closing and conversely speed-up on opening is then accomplished without necessity to resort to "dynamatic" mechanisms, two-speed clutches and the necessary controls therefor. The advantage of the invention has been achieved simply by modifying the type of pitman normally employed so that it has two arms instead of one and by connecting a link to the first arm and providing means for longitudinal guidance of the second. The arrangement is not only simple and economical as compared to the alternatives but readily adaptable to existing designs of underdrive presses. Moreover, the driving arrangement is inherently long-lived and may be operated for the life of the press without any special care or maintenance.

What I claim is:

1. In a power metal-forming press of the underdrive type the combination comprising a press frame having a base supporting a bed and having a driving assembly in the base, a slide in the frame vertically reciprocable with respect to the bed between an upraised position and a bottom position, the slide and the bed having provision for mounting of upper and lower cooperating dies, a rocker shaft journalled in the base and extending longitudinally along one side thereof, a pull rod arm on the rocker shaft, a vertical pull rod connected at its upper end to the slide and at its lower end to the pull rod arm, a rocker arm on the rocker shaft, the press drive assembly having a main drive gear radially spaced from the rocker arm and carrying an eccentric, means for rotating the main drive gear, a pitman having a central portion pivotally engaging the eccentric, the pitman having a short arm extending generally in the direction of the rocker arm and having a long arm extending in a direction generally opposite thereto, a connecting link pivoted to the short arm of the pitman and having its opposite end pivotally connected to the rocker arm, the connecting link having a reference orientation when the slide is in its bottom position, and an auxiliary link pivoted at one end to the end of the long arm of the pitman and pivoted at the other end to the frame, the long arm being so angled with respect to the position of the connecting link when the latter is in its reference orientation and the pivot on the frame being so located that upon rotation of the main drive gear the pivot on the short arm of the pitman traces a generally elliptical path having a major axis which bears an acute angle to the reference orientation of the connecting link with the result that the slide moves relatively slower as it approaches its bottom position and relatively faster as it leaves its bottom position.

2. In a power metal-forming press of the underdrive type the combination comprising a press frame having a base supporting a bed, and having a driving assembly in the base, a slide in the frame vertically reciprocable with respect to the bed between an upraised position and a bottoming position, the slide and the bed having provision for mounting of upper and lower cooperating dies, a rocker shaft journalled in the base and extending longitudinally along one side thereof, a pull rod arm on the rocker shaft, a vertical pull rod connected at its upper end to the slide and at its lower end to the pull rod arm, a rocker arm on the rocker shaft, the press drive assembly having a main drive gear spaced from the rocker arm and carrying an eccentric, means for rotating the main drive gear, a pitman having a central portion pivotally engaging the eccentric, the pitman having a short arm extending generally in the direction of the rocker arm and having a long arm extending in a direction generally opposite thereto, a connecting link pivoted to the short arm of the pitman and having its opposite end pivotally connected to the rocker arm, the connecting link having a reference orientation when the slide is in its bottom position, and guiding means operatively secured to the frame for guiding the end of the long arm along a generally longitudinal path, the angle of the long arm with respect to the position of the connecting link when the latter is in its reference orientation and the orientation of the guiding means being such that upon rotation of the main drive gear the pivot on the short arm of the pitman traces a generally elliptical path having a major axis which bears an acute angle to the reference orientation of the connecting link with the result that the slide moves relatively slower as it approaches its bottom position and relatively faster as it leaves its bottom position.

3. In a power metal-forming press of the underdrive type the combination comprising a press frame having a base supporting a bed and having a driving assembly in the base, the frame having a near side and a far side, a slide in the frame vertically reciprocable with respect to the bed between an upraised position and a bottoming position, the slide and the bed having provision for mounting of upper and lower cooperating dies, a pair of laterally spaced rocker shafts journaled in the base and extending horizontally in the base from the near side to the far side, pull rod arms connected to the ends of the shafts, a set of vertical pull rods connected at their upper ends to the slide and at their lower ends to the arms, the driving assembly including respective subassemblies at the near side and far side of the press, each subassembly including: a rocker arm secured to a respective one of the rocker shafts, a main drive gear radially spaced from the rocker arm and carrying an eccentric, a pitman having a central portion pivotally engaging the eccentric, the pitman having a short arm extending generally in the direction of the rocker arm and having a long arm extending in a direction generally opposite thereto and in the direction of the other rocker shaft, a connecting link pivoted to the short arm of the pitman and having its opposite end pivotally connected to the rocker arm, the link having a reference orientation when the slide is in its bottoming position, and guiding means operatively secured to the frame for guiding the end of the long arm along a generally longitudinal path, the angle of the long arm with respect to the position of the connecting link when the latter is in its reference orientation and the orientation of the guiding means being such that upon rotation of the main drive gear the pivot on the short arm of the pitman traces a generally elliptical path having a major axis which bears an acute angle to the reference orientation of the connecting link with the result that the slide moves relatively slower as it approaches its bottoming position and relatively faster as it leaves its bottoming position, and means for rotating the main drive gears in unison in opposite directions.

4. The combination as claimed in claim 3 in which the long arm of the pitman extends to a position adjacent the other one of the rocker shafts, and said guiding means including an auxiliary link pivoted to the end of the long arm and mounted for free swinging movement about the said other one of the rocker shafts, the long arm having a length such that the average orientation of the auxiliary link is generally at right angles to the average orientation of the long arm.

* * * * *